United States Patent [19]

Roberts

[11] 4,019,343

[45] Apr. 26, 1977

[54] REFRIGERATION SYSTEM USING ENTHALPY CONVERTING LIQUID TURBINES

[76] Inventor: Edward S. Roberts, 214-05 33rd Ave., Bayside, Queens, N.Y. 11361

[22] Filed: Apr. 23, 1976

[21] Appl. No.: 679,690

Related U.S. Application Data

[63] Continuation-in-part of Ser. No. 648,628, Jan. 13, 1976, abandoned.

[52] U.S. Cl. ..... 62/510

[51] Int. Cl.[2] ..... F25B 1/10

[58] Field of Search ..... 62/510, 116, 500, 501, 62/115, 498

[56] References Cited

UNITED STATES PATENTS

| | | | |
|---|---|---|---|
| 2,966,047 | 12/1960 | De Paravicni | 62/510 |
| 3,527,059 | 9/1970 | Rust et al. | 62/115 |
| 3,668,884 | 6/1972 | Nebgen | 62/510 |
| 3,954,430 | 5/1976 | Curtis et al. | 62/510 |

*Primary Examiner*—Lloyd L. King
*Attorney, Agent, or Firm*—Robert Ames Norton; Saul Leitner

[57] ABSTRACT

A refrigeration system in which refrigerant liquid is cooled by self-evaporation and is used for refrigerating in the liquid form, in which the self-evaporation is in stages, each having a vapor compressor, the expansion taking place in enthalpy converting liquid turbines instead of permitting partial vaporization through valves into vapor separators. The enthalpy converting liquid turbines are much more efficient than the adiabatic liquid expansion which is customarily used in refrigeration systems in which a cold liquid cooled by the expansion is evaporated to absorb heat and thus to provide cooling. There is much less irreversibility and hence increase in entropy is reduced, especially when removal of super heat from the compressed vapors in each stage is effected by quenching with a small portion of the refrigerant liquid. A good portion of this heat is recovered as mechanical energy in the enthalpy converting turbines. With ammonia as the refrigerant, improvements of efficiency of 15% and more are achieved. Other refrigerants may be used instead of ammonia and the choice of refrigerant used is based on the conditions of operation. The type of refrigeration system is normally used for fairly large scale refrigeration plants and is not suitable for home refrigerators.

8 Claims, 2 Drawing Figures

REFRIGERATION SYSTEM USING ENTHALPY CONVERTING LIQUID TURBINES

This application is a continuation-in-part of my earlier application, Ser. No. 648,628, filed Jan. 13, 1976, which is now abandoned.

BACKGROUND OF THE INVENTION

Large scale refrigeration systems in which a refrigerant is chilled in the liquid form by self-evaporation in stages are well known. The self-evaporation is effected by pressure lowering suitable expansion valves into vapor liquid separators and the vapors compressed back up to condenser pressure. As the operation involves adiabatic expansions, the increase in entropy is quite marked and hence, of course, the power required is greater and efficiency is less. With ammonia as a refrigerating element, it is difficult to achieve efficiencies, over theoretical completely reversible Carnot cycles, of significantly more than about 50%. Thus while the self-cooled liquid systems are extensively used for large scale refrigeration, there is still a substantial power cost; and therefore the systems, although practically useful, leave considerable to be desired from the standpoint of power consumption and efficiency. It is with an improved refrigeration system of the self-cooling liquid type but with improved efficiencies that the present invention deals.

SUMMARY OF THE INVENTION

In the present invention instead of using adiabatic expansion through a valve, and hence vaporization of a considerable portion of the liquid refrigerant before it has been used for cooling, it is expanded in stages through enthalpy converting liquid turbines. In these turbines the partial evaporation of the refrigerant may be used to produce a rapid flow of liquid through nozzles, in other words, thermal energy can be converted into kinetic energy, which, in turn, is converted to mechanical energy, and there is separation of the vapor produced in the turbine. This vapor in each of the multiple stages can then be compressed, preferably by turbo compressors, and superheat of compression is removed by quenching with a small portion of the refrigerant liquid; in other words, the compressions are effected with inter-cooling between stages, using a portion of the refrigerant liquid.

When ammonia is used as a refrigerant, efficiencies, as compared to a fully reversible Carnot cycle, of almost 60% can be achieved as compared with about 51½% efficiency, which is the best that can be obtained in the conventional system where chilling of the liquid is by adiabatic expansion of a portion thereof, thus representing an increase in efficiency of about 15.5%. It should be understood that the present invention is a practical one for a large refrigeration plant, and while the savings are very great, 100% efficiency cannot be achieved. However, the only irreversibility, besides machine efficiency and temperature difference across heat exchangers, is the removal of the superheat from the gases leaving the refrigerant vapor compressors in the various stages. As has been pointed out above, the removal of superheat is best effected by quenching with a portion of the spent refrigerant liquid, which evaporates at saturation at the discharge pressure of each compressor. The figures given above assume that machinery, such as liquid turbines and the like, is chosen for maximum practical efficiency. If this is not done and the efficiency of the machinery decreases, results begin to approach more nearly to the efficiencies obtained with a conventional system. In other words, the large energy savings which the present invention makes possible are obtained only if intelligent selection of high efficiency machinery is used.

Proper staging is important to obtaining good compression efficiencies and permits matching of outlet of compressors with inlet of enthalpy converters in each pair.

The characteristics of ammonia as a refrigerant render it preferable in certain cases but in broader aspects the invention is not limited thereto, and other suitable refrigerants, such as fluoro-chloro-carbons, may be employed. Because of the extensive equipment required for the important savings in power of the present invention, it is suitable only for larger installations and is not suitable for small home refrigerators.

In its broader aspects the present invention is not limited to a particular type or design of liquid turbine. A very suitable type is an impulse turbine, such as a Pelton wheel, in which gas and liquid are also separated. The impulse turbines are illustrated diagrammatically in the description of the drawings and preferred embodiments below. Turbo compressors for the vapor separated in the liquid turbines may be of standard design, which reduces equipment cost. In the drawings they are illustrated diagrammatically as are the enthalpy converting liquid turbines. The present invention is essentially a combination of elements or process steps producing an improved result and is not limited to any particular exact design of turbines or compressors taken by themselves. It is the improved result obtainable by the present invention which is the essential distinguishing feature of the invention over the prior art.

The refrigerant, cooled in stages by self-evaporation, is a liquid which can be used for cooling purposes without change of phase, and for many purposes this is preferred, or part or all of the cold liquid may evaporate during the chilling cycle. The present invention is not limited to using the cold liquid for chilling without change of phase though for many purposes this very efficient operation is desirable. Essentially the present invention stops when the cold liquid has been produced and the way it is used for chilling, either without change of phase or with evaporation of part or all of it, is not the distinguishing feature of the present invention. In order to smooth out the flow of liquid and vapor in the enthalpy converters, it is possible to apply sonic vibration, but not necessarily in the human audible spectrum, to the expanding liquid in or just beyond the nozzles but the invention is not limited thereto.

DESCRIPTION OF THE PREFERRED EMBODIMENTS

Figure 1:
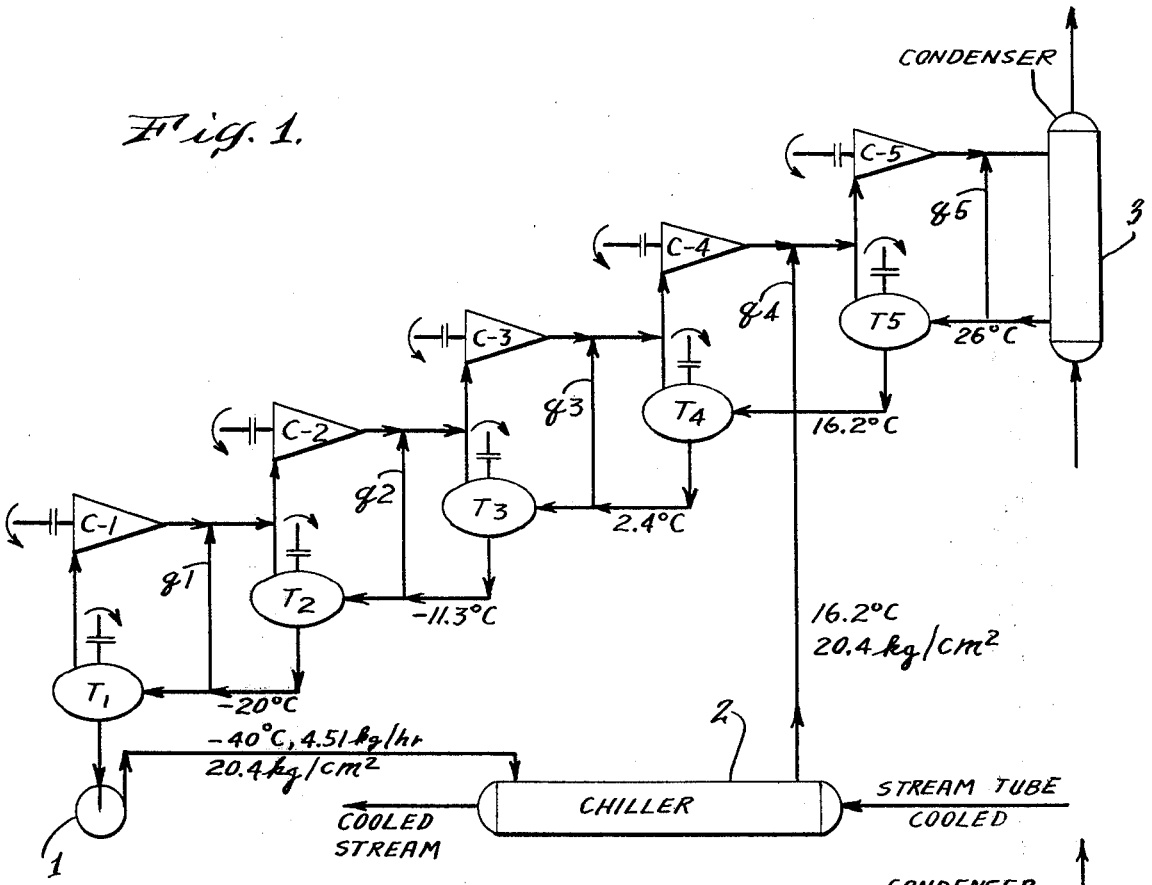
FIG. 1 is a diagrammatic illustration of a refrigeration system of the present invention.
Figure 2:
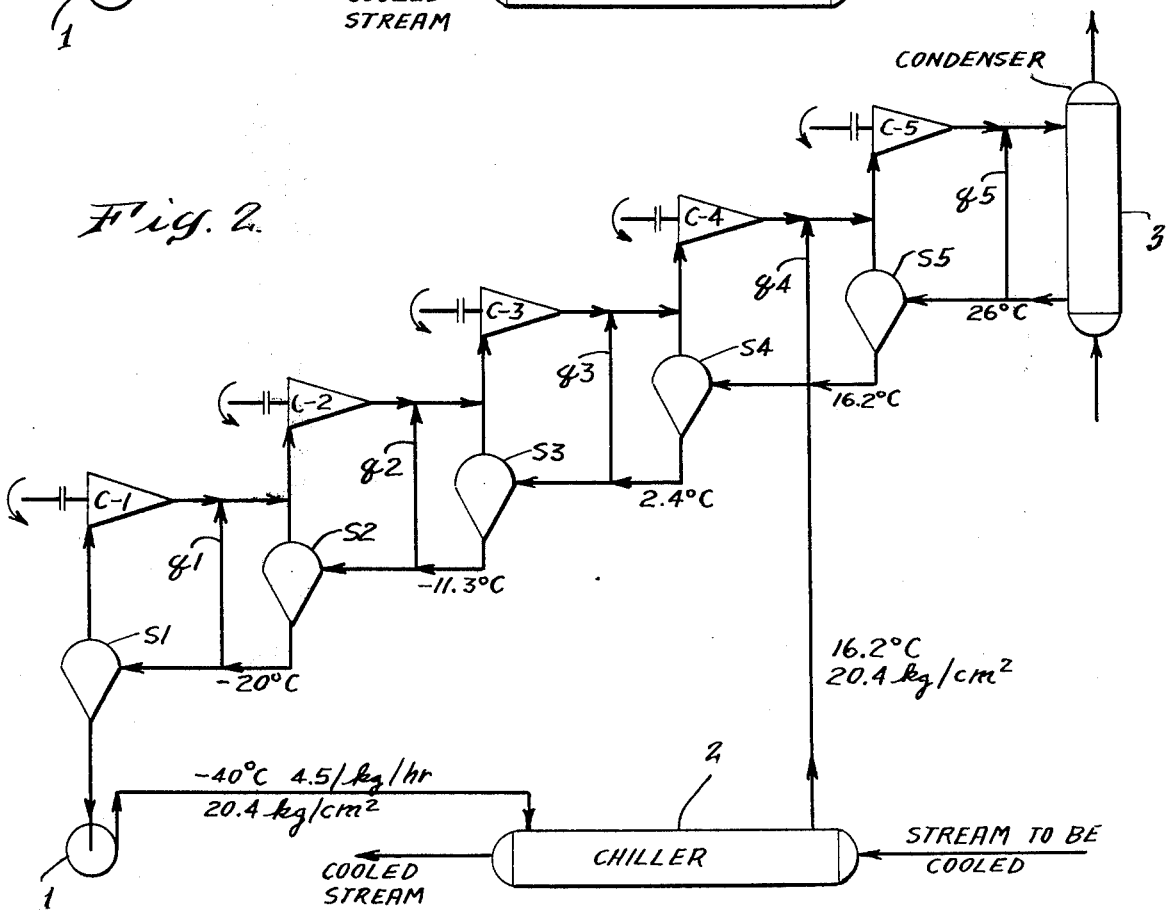
FIG. 2 is a similar diagrammatic illustration of a conventional system using adiabatic refrigerant expansion.

In describing the invention in conjunction with FIG. 1 and as comparison with the known systems shown in FIG. 2, the figures are for a large refrigeration plant operating on ammonia as the refrigerant and using about $4.53 \times 10^{10}$ kg. of refrigerant per hour. The invention is not, of course, limited to plants of this exact size, but, as has been pointed out above, the plants must be quite large as the advantages of the present invention from the standpoint of cost of power versus equipment do not at the present time make the invention worthwhile for home refrigerators or freezers.

Liquid ammonia is pumped by the liquid pump 1 to 7.485 ata. at −40° C. into a chiller or refrigerator 2, which is shown purely diagrammatically as the present invention does not change chiller design and any suitable design may be used. As can be seen on the drawing, a stream to be cooled is shown entering the chiller 2. Flow direction is indicated by arrows. In order to make the drawing easier to follow in the following description, temperatures and pressures at various points are shown on the drawing. In each case the temperature is in degrees Celsius and rounded off to not more than one decimal place.

In FIG. 1 the liquid enthalpy converting turbines are numbered $T_1$, $T_2$, $T_3$, $T_4$, and $T_5$. Each turbine performs two functions: one is to expand and so reduce the pressure and the temperature of the liquid and the other, to separate liquid from vapor at the expanded pressure. Each liquid turbine is associated with a turbo compressor for vapors separated in the turbines, the compressors being numbered $C_1$, $C_2$, $C_3$, $C_4$, and $C_5$. Compression in each compressor is to the pressure in the following liquid turbine. This results in superheating the vapors, and the superheat is removed by a small portion of the liquid from the preceding turbine. In other words, the vapors compressed by compressor $C_1$ have their superheat removed by a portion of the liquid leaving liquid turbine $T_2$, and so on. The last compressor, $C_5$, compresses vapors entering a condensor 3, where they are condensed to a liquid at 26° C., and as shown on FIG. 1, the superheat from compressor $C_5$ is removed by quenching with a small portion of the liquid leaving condenser 3. For clarity, these streams which remove superheat and which, therefore, act as quench streams are numbered $q_1$, $q_2$, $q_3$, $q_4$, and $q_5$, corresponding to the compressors $C_1$ to $C_5$. It will be noted that the refrigerant liquid leaving the chiller 2 passes into turbine $T_4$ together with the expanded and cooled liquid from Turbine $T_5$.

The liquid turbines are chosen to have an 85% isentropic efficiency. Isentropic efficiency of the vapor compressors is 70% and the efficiency of the pump 1 is 65%. On calculating the power required, it is approximately 80833 ks. When this is compared with a completely reversible cycle using integrated Carnot cycle and constant specific heat, the formula gives a power requirement of 48132 KW; the ratio to the actual power × 100 is 59.54%.

FIG. 2 is similar to FIG. 1 but the enthalpy converting liquid turbines $T_1$ to $T_5$ are replaced with conventional expansion valves followed by liquid vapor separators $S_1$ to $S_5$, in each of which liquid from the preceding separator is expanded through a conventional expansion valve. Compressors $C_1$ to $C_5$ are the same as in FIG. 1 and operate at the same 70% isentropic efficiency. The pump 1 for liquid refrigerant also operates at 65% efficiency, and superheat from the compressors is quenched by a portion of cooled liquid, which, however, is taken, of course, from the preceding vapor-liquid separator and is labelled $q_1$ to $q_5$ as in FIG. 1. In other words, the superheat from compressor $C_1$ is obtained by quenching with a portion of the liquid from separator $S_2$. The quenching of the superheat from compressor $C_5$ is obtained, as in FIG. 1, by a portion of the liquid from the condenser 3. Calculating numbers as applied in the case of FIG. 1, the amount of power required is 93399 kw., which gives an efficiency of 51.53% as compared to the fully reversible cycle. This comparison is the same as in FIG. 1, and it can therefore be seen that the improvement in efficiency, i.e., $[(59.54/51.53) - 1] \times 100$, is approximately 15.5%.

I claim:

1. In a refrigeration system in which a refrigerant is cooled by self evaporation with compression of vapors and condensation, the improvement which comprises, a. introducing the cold refrigerant at a preselected temperature through a chilling zone in which it is in heat exchange with the material to be cooled and passes through with or without change of phase of at least part of the liquid, and b. flowing liquid from the refrigerant condenser through a series of enthalpy converting liquid turbines, entering one of which it is joined by any heated refrigerant liquid from the chilling zone, in each turbine the liquid decreases in pressure and temperature and vapors are separated, each turbine being paired with a vapor compressor receiving the separated vapors and each turbine passing liquid on to the next turbine in the series, the compression of vapors being to the pressure of the preceding turbine.

2. A system according to claim 1 in which the series of turbines and compressors results in stages so that the output of each compressor substantially matches the inlet of its paired enthalpy converting turbine.

3. A system according to claim 1 in which compressed vapors from the highest pressure compressor are condensed into liquid and the superheat or heat of compression is quenched by a portion of the condensed liquid from the condenser by direct admixture of a small portion of cold liquid from each liquid turbine, the small portion of liquid being directly admixed in each case with the compressed vapor, whereby in the last liquid turbine liquid temperature is reduced to a predetermined low temperature and the cycle is repeated.

4. A system according to claim 2 in which compressed vapors from the highest pressure compressor are condensed into liquid and the superheat or heat of compression is quenched by a portion of the condensed liquid from the condenser by direct admixture of a small portion of cold liquid from inlet of each paired liquid turbine, the small portion of liquid being directly admixed in each case with the compressed vapor, whereby in the last liquid turbine liquid temperature is reduced to a predetermined low temperature and the cycle is repeated.

5. A system according to claim 1 in which the refrigerant is ammonia.

6. A system according to claim 2 in which the refrigerant is ammonia.

7. The system according to claim 3 in which the refrigerant is ammonia.

8. A system according to claim 4 in which the refrigerant is ammonia.

* * * * *